US006752042B1

(12) United States Patent
Dawson

(10) Patent No.: US 6,752,042 B1
(45) Date of Patent: Jun. 22, 2004

(54) CAP POPPER

(75) Inventor: Phillip R. Dawson, Sullivan, OH (US)

(73) Assignee: Dawson/Dawson/Biglin Partnership, Sullivan, OH (US)

( * ) Notice: Subject to any disclaimer, the term of this patent is extended or adjusted under 35 U.S.C. 154(b) by 11 days.

(21) Appl. No.: 10/253,143

(22) Filed: Sep. 23, 2002

(51) Int. Cl.[7] ..... B76B 7/00; F42B 33/00

(52) U.S. Cl. ..... 81/3.55; 81/3.56; 81/302; 86/37; 86/24; 29/268

(58) Field of Search ..... 81/3.05, 3.07, 81/3.08, 3.09, 3.36, 3.44, 3.55, 3.56, 302; 29/268; 433/4; 42/108, 51; 86/24, 45, 36, 37, 38, 27, 23; 294/13

(56) References Cited

U.S. PATENT DOCUMENTS 478,009 A * 6/1892 Hollis ..... 81/302
3,233,313 A * 2/1966 Roth ..... 81/302
3,357,085 A * 12/1967 Martin ..... 29/268
4,018,110 A * 4/1977 Spriggs ..... 81/3.08
4,509,392 A * 4/1985 Smith ..... 81/302
4,537,112 A * 8/1985 Dabonde ..... 86/37
4,658,489 A * 4/1987 Johnston ..... 29/268
4,813,827 A * 3/1989 Dugger ..... 86/24
5,077,879 A * 1/1992 Haviv ..... 29/268

* cited by examiner

*Primary Examiner*—D. S. Meislin
(74) *Attorney, Agent, or Firm*—The Kline Law Firm

(57) ABSTRACT

A tool designed to remove a primer cap from a muzzleloader, the cap popper comprises a pair of flat blades joined with a hinge. A first end of the cap popper is wedged between the gun nipple and the primer cap. The other ends of the cap popper blades are then squeezed together by the user, forcing the primer cap off the nipple. A built-in cap holder is supplied to hold fresh primer caps.

4 Claims, 3 Drawing Sheets

CAP POPPER

BACKGROUND OF THE INVENTION

1. Field of the Invention

The present invention relates generally to tools used on firearms, and more particularly is a tool designed to remove a primer cap that is stuck on the primer nipple of a muzzleloader firearm.

2. Description of the Prior Art

A muzzleloader firearm is loaded by packing powder and shot in the barrel of the gun, and then inserting a primer cap in a primer nipple to enable firing of the weapon. Occasionally the primer cap becomes jammed on the nipple, and must be removed. A hunter in the field however will often not have the proper tools to remove the nipple safely.

A common current emergency tool for cap removal is a knife. The knife blade may however cut the cap into pieces, thereby removing only part of the cap. Worse, the blade may cause injury to the hunter's hand or fingers. Worse yet, the use of a knife on the cap can cause accidental discharge of the muzzleloader, a very significant safety risk.

Accordingly, it is an object of the present invention to provide a tool that can be easily carried by a hunter in the field.

It is a further object of the present invention to provide a tool that will efficiently remove a stuck cap without damage to the cap or risk of injury to the hunter's hands or fingers.

SUMMARY OF THE INVENTION

The present invention is a tool, a cap popper, designed to remove a primer cap from a muzzleloader. The cap popper comprises a pair of flat blades joined with a hinge. A first end of the cap popper is wedged between the gun nipple and the primer cap. The other ends of the cap popper blades are then squeezed together by the user, forcing the primer cap off the nipple. A cap holder retains the cap in the popper so that it is easily retrieved by the user. A return spring returns the blades to an original closed position after the popper is used to remove the primer cap.

An advantage of the present invention is that it enables the user to safely and easily remove a cap from a firearm nipple.

Another advantage of the present invention is that it is small enough to be conveniently carried in a pocket.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
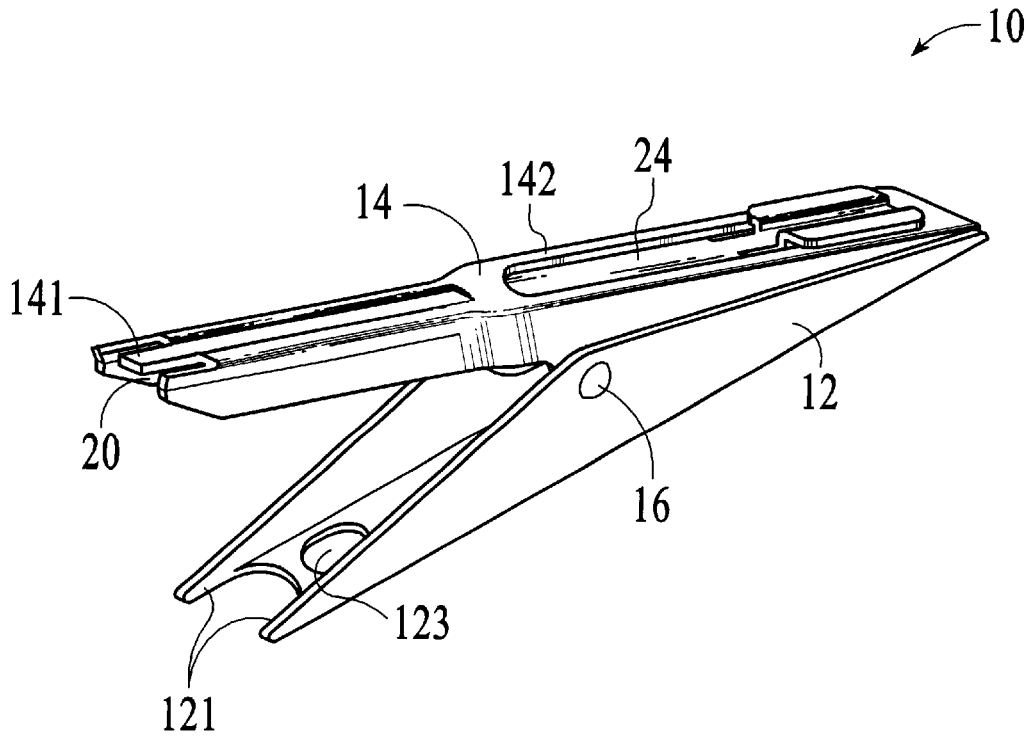
FIG. 1 is a perspective view of the cap popper of the present invention in an open position.
Figure 3:
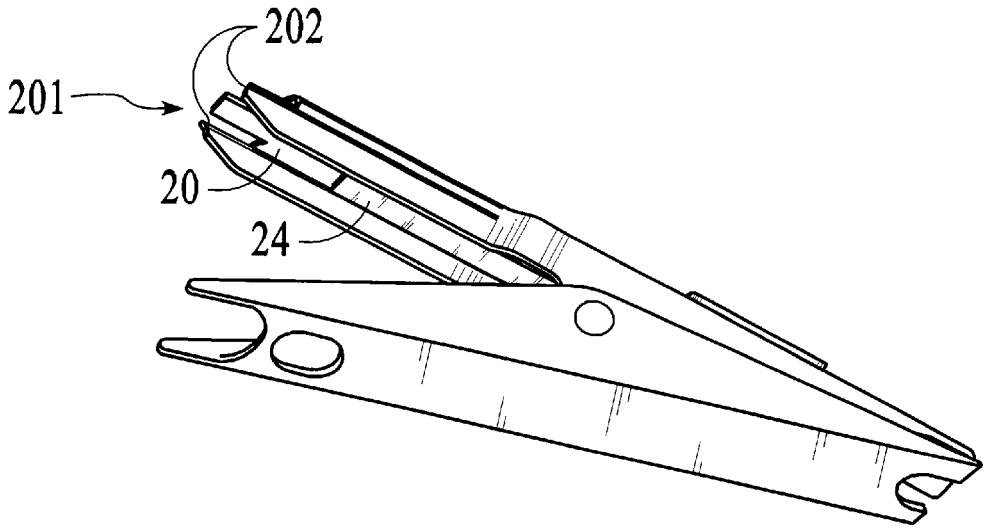
FIG. 3 is a front end view of the top blade of the cap popper.
Figure 2:
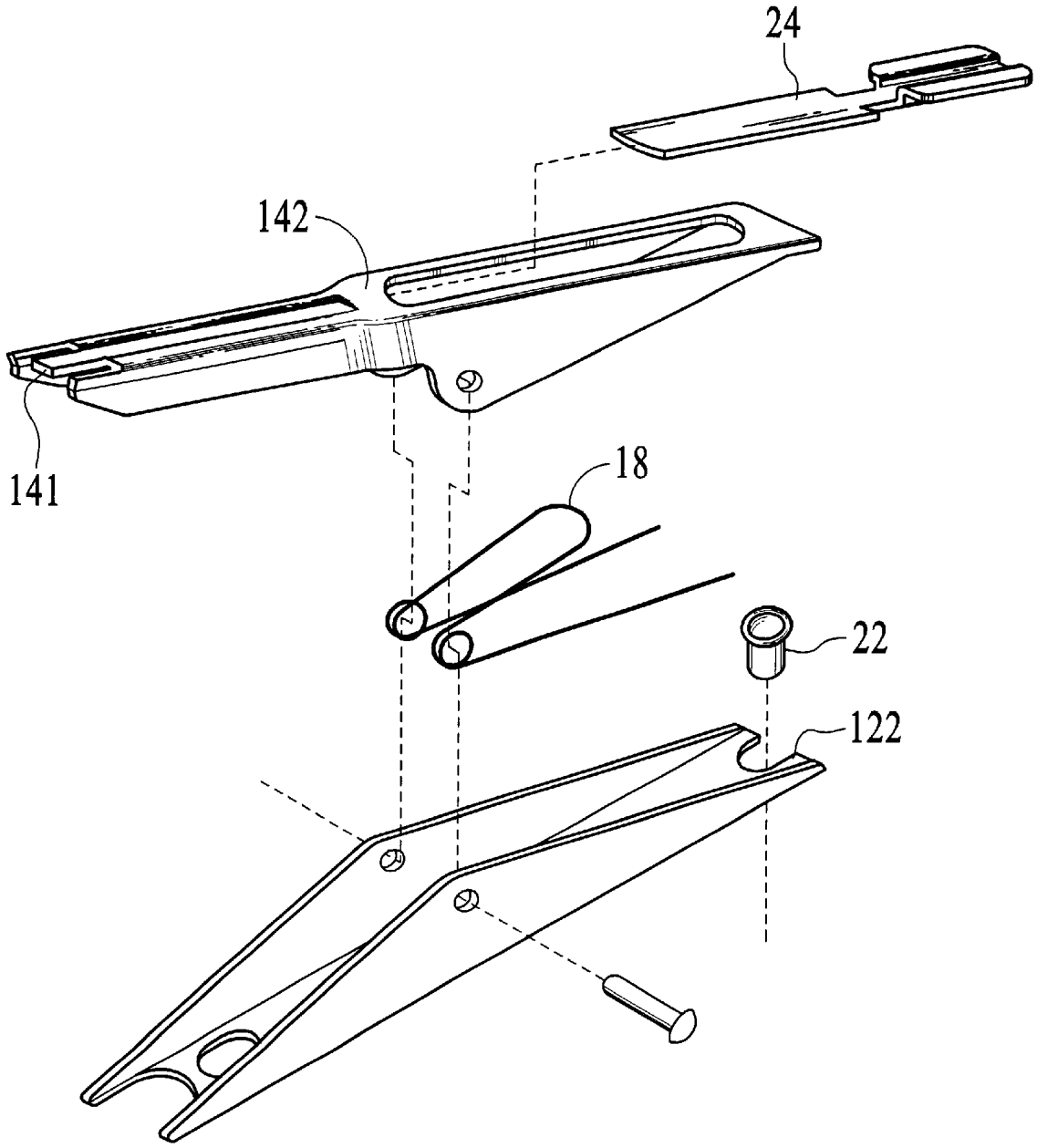
FIG. 2 is an exploded view of the cap popper of the present invention.
Figure 4A:
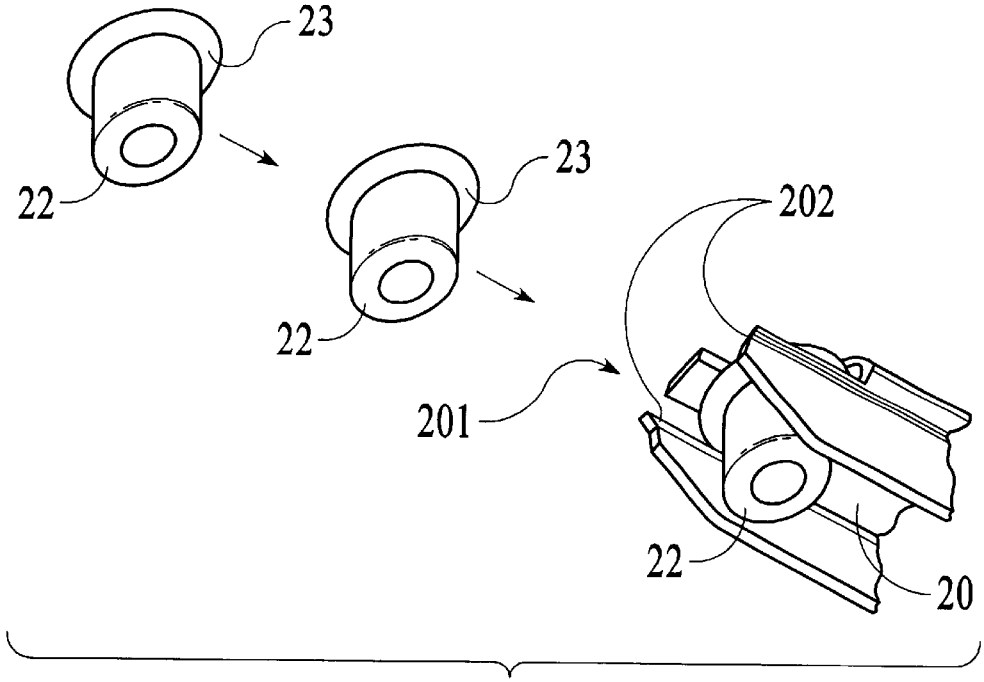
FIG. 4A shows the cap holder of the cap popper.
Figure 4B:
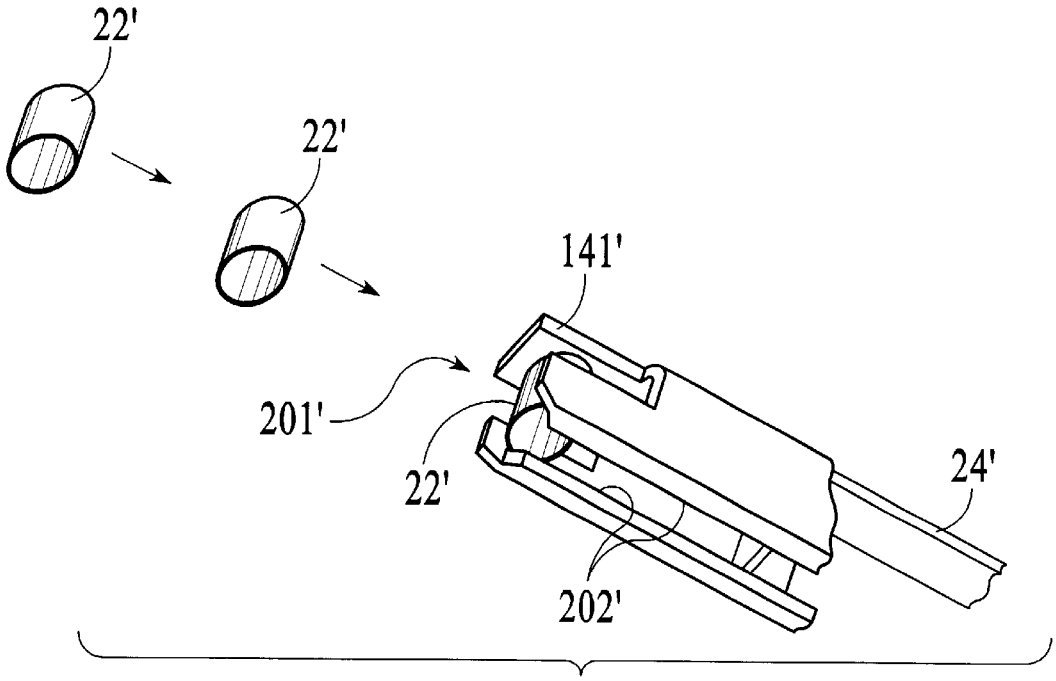
FIG. 4B shows the cap holder of the cap popper adapted for a second kind of primer cap.

The present invention is a tool, a cap popper 10, that is designed to remove a primer cap from a muzzleloader firearm. The cap popper 10 comprises a bottom base blade 12 and a top blade 14. The top blade 14 is attached to the bottom blade 12 by means of a hinge axle 16. A return spring 18 is mounted around the hinge axle 16 to urge the cap popper 10 toward a closed position.

The bottom blade 12 includes an arced pair of alignment shoulders 121 at a first end. The opposite end of the bottom blade 12 terminates in a claw grip 122. The claw grip 122 will typically have a larger arc than the alignment shoulders 121. An oval staging hole 123 may be located behind the claw grip 122.

The top blade 14 of the cap popper 10 includes at a first end a probe 141, 141' that is situated on a top side of a built-in cap holder 20. The cap holder 20 is a channel that is adapted to hold primer caps 22, 22'. The channel of the cap holder 20 has a cap mouth 201, 201' at a front end to release the primer caps 22, 22'. Slide element 24, 24' is mounted in a slot 142 in a second end of the top blade 14 to advance caps 22, 22' along the cap holder 20. Primer caps 22 with a lip 23 on a top end simply slide along the tops of the side rails 202 of the cap holder 20. For primer caps 22' with no lip, the lower edges 202' of the side rails extend inward to provide a surface to hold the primer caps 22'.

In use, the front end of the cap popper 10 is placed on a gun nipple by positioning the alignment shoulders 121 around the bottom of the firearm nipple with the cap popper in the closed position. The user then simply squeezes together the open ends of the blades 12, 14 of the cap popper 10, and the probe 141, 141' lifts the primer cap 22, 22' off the nipple of the gun. When the ends of the blades 12, 14 are squeezed together by the user, the cap popper 10 is moved to the open position shown in FIG. 1.

For primer caps 22, 22' that prove to be particularly stubborn, the claw grip 122 on the second end of the bottom blade 12 can be used to apply greater force.

The cap holder 20 can be loaded with primer caps 22, 22' when the cap popper 10 is in the open position. The slide 24, 24' is moved to advance the caps 22, 22' toward the mouth 201, 201' of the holder 20. The fresh primer cap 22, 22' is then simply lowered onto the nipple of the firearm, and the cap popper 10 is removed.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A primer cap remover tool comprising:

a bottom blade, a top blade, and a hinge axle joining said bottom blade and said top blade; wherein a first end of said bottom blade comprises a pair of alignment shoulders, such that a user positions said primer cap remover by placing said alignment shoulders around a nipple of a firearm with a stuck primer cap, the user then squeezing together rear ends of said bottom blade and said top blade so as to force apart front ends of said bottom blade and said top blade, a probe on said top blade thereby contacting the primer cap to apply force to the primer cap, and wherein said cap holder comprises a channel to hold primer caps and a slide element mounted in communication with said channel to urge the primer caps along said channel.

2. The primer cap remover tool as defined in claim 1, wherein:

a spring is mounted on a hinge axle between said bottom blade and said top blade so as to urge said primer cap remover toward a closed position.

3. The primer cap remover tool as defined in claim 1, wherein:

a second end of said bottom blade comprises an arced claw grip.

4. The primer cap remover tool as defined in claim 1, wherein:

said top blade further comprises a built-in cap holder.

* * * * *